US012324533B1

(12) United States Patent
He

(10) Patent No.: US 12,324,533 B1
(45) Date of Patent: Jun. 10, 2025

(54) ROTATABLE FOOD AND BEVERAGE HOLDER

(71) Applicant: Juan He, Guangdong (CN)

(72) Inventor: Juan He, Guangdong (CN)

( * ) Notice: Subject to any disclaimer, the term of this patent is extended or adjusted under 35 U.S.C. 154(b) by 0 days.

(21) Appl. No.: 18/967,701

(22) Filed: Dec. 4, 2024

(30) Foreign Application Priority Data

Aug. 2, 2024 (CN) ..... 202421868741.7

(51) Int. Cl.
*A47G 23/00* (2006.01)
*A47G 23/06* (2006.01)

(52) U.S. Cl.
CPC ..... *A47G 23/0641* (2013.01)

(58) Field of Classification Search
CPC ..... A45C 11/20; A45C 13/02; A45C 13/26; A45C 13/28; A47G 19/06; A47G 19/065; A47G 19/02; A47G 19/30; A47G 19/00; A47G 19/04; A47G 23/06; A47G 23/0208; B65D 25/04; B65D 71/0003; B65D 71/004
USPC ..... 206/549, 217, 373, 162; 220/23.86, 555, 220/575, 735, 212, 556
See application file for complete search history.

(56) References Cited

U.S. PATENT DOCUMENTS

| | | | | |
|---|---|---|---|---|
| 3,640,380 | A * | 2/1972 | Huffman | A47J 47/14 229/117.14 |
| 5,285,940 | A * | 2/1994 | Goulter | A45F 5/00 224/265 |
| 7,806,305 | B1 * | 10/2010 | Moore, Jr. | A45F 5/00 224/265 |
| 11,957,259 | B2 | 4/2024 | Jakubowski et al. | |
| 12,071,975 | B2 | 8/2024 | McGrath | |
| 2013/0133556 | A1 | 5/2013 | Ochi | |
| 2016/0015220 | A1 * | 1/2016 | Dean | B31B 50/62 53/457 |
| 2023/0159215 | A1 | 5/2023 | Connolly | |

* cited by examiner

*Primary Examiner* — King M Chu
(74) *Attorney, Agent, or Firm* — S.J. Intellectual Property LTD.

(57) ABSTRACT

A rotatable food and beverage holder includes a beverage rack with a handle and a first tank; a food rack rotatably mounted on a side of the beverage rack and provided with a second tank. When the beverage rack is rotated, the food rack remains stationary due to its own weight. In use, a container is placed in the first tank of the beverage rack, and one or more types of food such as fried chicken, chicken nuggets, peanuts, chips, or fries are placed in the second tank of the food rack. When a user holds the handle of the beverage rack and tilts it to pour out the liquid from the container or the tank to drink, the food rack remains stationary due to its own weight.

12 Claims, 3 Drawing Sheets

ROTATABLE FOOD AND BEVERAGE HOLDER

CROSS REFERENCE TO RELATED APPLICATIONS

This application claims priority of Chinese patent application CN 2024218687417, filed on Aug. 2, 2024, the contents of which are incorporated herein by reference in their entirety.

TECHNICAL FIELD

The present disclosure relates to the technical field of daily necessities, and in particular, relates to a rotatable food and beverage holder.

BACKGROUND

Beverages are generally divided into alcoholic and non-alcoholic beverages. Non-alcoholic beverages, also known as soft drinks, have an alcohol content of less than 0.5% (v/v) and are primarily intended to replenish body fluids of people. They include carbonated drinks, fruit and vegetable juices, tea drinks, etc. Alcoholic beverages are those with an ethanol (alcohol) content ranging from 0.5% to 65% (v/v), including various fermented, distilled, and mixed drinks.

Currently, people typically drink beverages by either drinking directly from the beverage container, pouring them into a cup, or using a straw inserted into the beverage container. In all these methods, one needs to hold the beverage container (such as a bottle or cup) with one hand. When people leave a table where food is placed, they often tend to drink while eating various foods such as fried chicken, chicken nuggets, peanuts, chips, or fries. However, since one hand is occupied with the beverage container, only the other hand can be used to hold one type of food. This requires constantly picking up different foods, making the process a hassle and failing to meet a user's needs. Additionally, it prevents the other hand from being free to perform other tasks, causing significant inconvenience.

SUMMARY

In order to solve the above problem, the embodiments of the present disclosure provide the following technical solution. A rotatable food and beverage holder includes: a beverage rack, provided with a handle configured for a user to hold and a first tank configured for accommodating a container or a liquid; and a food rack, rotatably mounted on a side of the beverage rack and provided with a second tank for placing food. The food rack remains stationary under its own weight in response to the beverage rack being rotated.

BRIEF DESCRIPTION OF THE DRAWINGS

The description and drawings that constitute a part of the present disclosure are provided for a further understanding of the present disclosure. The illustrative embodiments and their descriptions are provided for explanation but do not constitute improper limitations on the present disclosure.

DETAILED WAY

Figure 1:
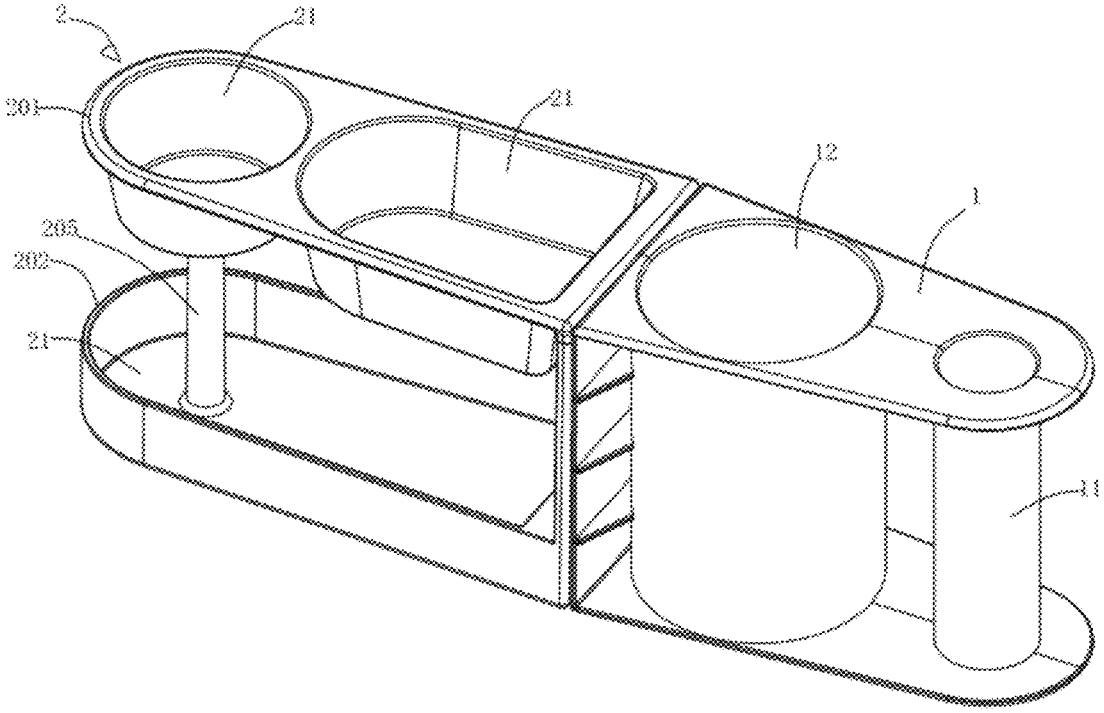
FIG. 1 is a perspective view in accordance with the embodiments of the present disclosure.
Figure 2:
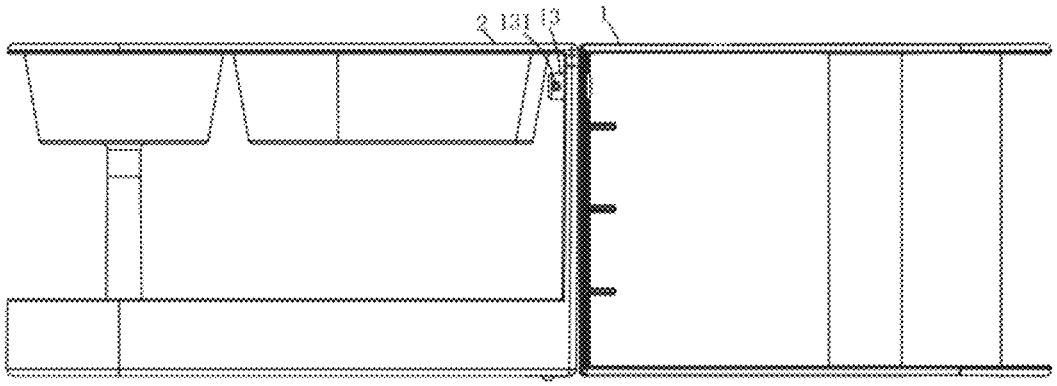
FIG. 2 is a front view in accordance with the embodiments of the present disclosure.
Figure 3:
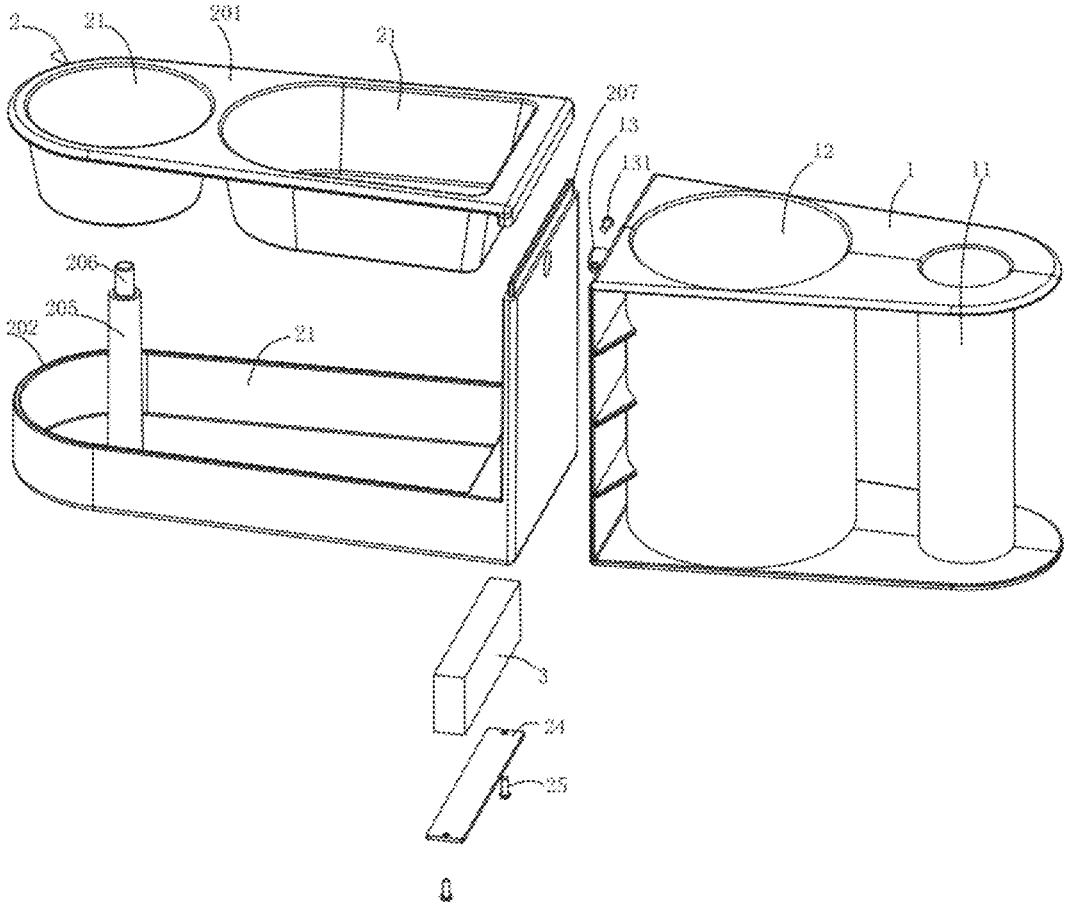
FIG. 3 is an exploded, perspective view in accordance with the embodiments of the present disclosure.
Figure 4:
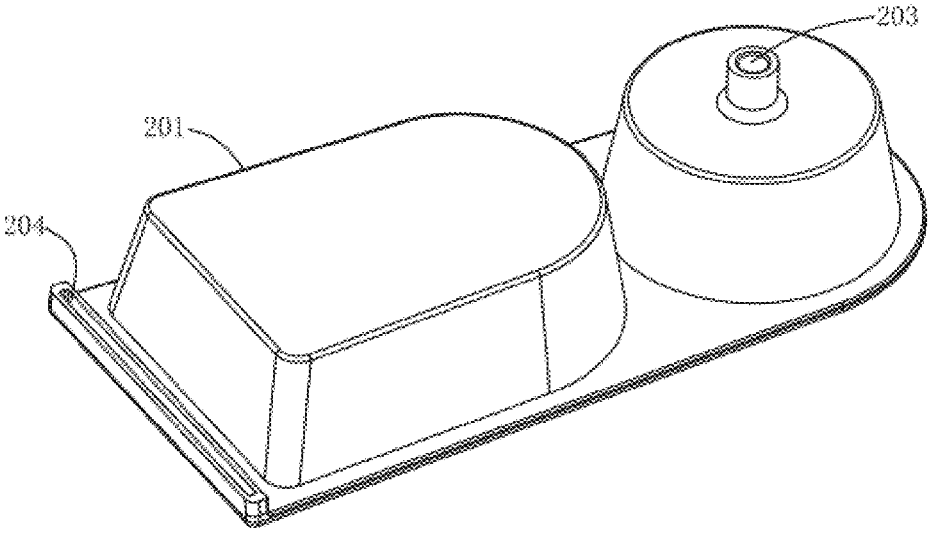
FIG. 4 is a perspective view of an upper frame in accordance with the embodiments of the present disclosure.
Figure 5:
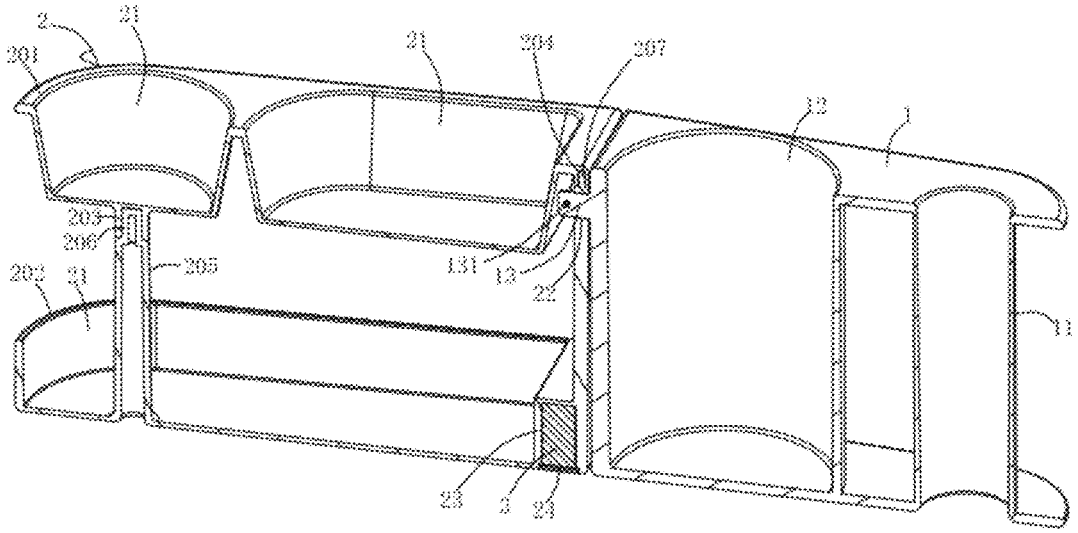
FIG. 5 is a sectional view in accordance with the embodiments of the present disclosure.

The present disclosure may be described in detail below with reference to the accompanying drawings and in conjunction with various embodiments. Each example is provided to explain but not limit the present disclosure. In fact, it may be clear to those of ordinary skill that modifications and variations may be made without departing from the scope or spirit of the present disclosure. For example, a feature shown or described as part of one embodiment may be used according to another embodiment to produce yet another embodiment. Therefore, it is intended that the present disclosure includes such modifications and variations within the scope of the appended claims and their equivalents.

In the description of the present disclosure, the terms "longitudinal", "lateral", "upper", "lower", "front", "back", "left", "right", "vertical", "horizontal", "top", "bottom" and the like indicate the orientational or positional relationship based on the orientational or positional relationship illustrated in the drawings, which is only for the convenience of describing and does not require the present disclosure to be constructed and operated in a specific orientation, and therefore cannot be understood as limiting the present disclosure. The terms "connected", "connecting" and "arranged" used in the present disclosure should be understood in a broad sense. For example, it may be a fixed connection or a detachable connection; it may be directly connected or indirectly connected through an intermediate component; it may also be a wired electrical junction, a radio connection, or a wireless signal connection. For those of ordinary skill in the art, the specific meanings of the above terms may be understood according to the specific circumstances.

One or more examples of the present disclosure are illustrated in the attached drawings. Numbers and letter signs are used in the detailed description to refer to features in the drawings. Similar signs in the drawings and descriptions have been configured to refer to similar parts of the present disclosure. As used herein, the terms "first", "second" and "third" are used interchangeably to distinguish one component from another and are not intended to indicate the position or importance of individual components.

The present disclosure is further described below in conjunction with specific embodiments and drawings.

As shown in FIG. 1 to FIG. 5, a rotatable food and beverage holder includes a beverage rack 1 and a food rack 2.

The beverage rack 1 is provided with a handle 11 for a user to hold, and the beverage rack 1 is also provided with a first tank 12 for accommodating liquid or for accommodating a container filled with liquid. The food rack 2 is rotatably mounted on one side of the beverage rack 1. The food rack 2 is provided with a second tank 21 for placing food. When the beverage rack 1 rotates, the food rack 2 remains stationary under its own gravity. When the device of present disclosure is used, a container filled with liquid is placed in the first tank 12 of the beverage rack 1 or liquid is directly filled in the first tank 12; one or more of a variety of foods such as fried chicken, chicken nuggets, peanuts, potato chips, French fries, etc. are placed in the second tank 21 on the food rack 2. When a user holds the handle 11 of the beverage rack 1 and tilts it to pour out the liquid in the container or the liquid in the first tank 12 to drink, the beverage rack 1 rotates. However, due to that the food rack 2 is rotatably mounted on one side of the beverage rack 1, the food rack 2 remains stationary under its own gravity, thereby ensuring that the food may not accidentally fall off from the second tank 21 of the food rack 2, allowing the user's another hand to be freed. The user can not only take any food in the second tank 21 of the food rack 2 to eat with the other hand, but also does not need to go back and forth to the table fetching different foods. Therefore, the purpose of quickly and conveniently taking food away from the table can be achieved, and the freed other hand can also perform other tasks. The device of the present disclosure is extremely convenient to use and meets different requirements of different consumers.

The beverage rack 1 and the food rack 2 have at least the following two structures.

The first structure is configured as: an upper outer portion of the beverage rack 1 is provided with an axial shaft 13, an upper outer portion of the food rack 2 is defined with a hole 22. The axial shaft 13 couples with the hole 22 to form a rotatable connection, and a first screw or pin 131 is also provided at an end of the axial shaft 13 to prevent the axial shaft from being decoupled from the hole 22.

The second structure is: an upper outer portion of the beverage rack 1 is provided with an axial shaft 13, and an upper outer portion of the food rack 2 is provided with a bearing. The axial shaft 13 couples with an inner circular space of the bearing to form a rotatable connection, and a first screw or pin is also provided at an end of the axial shaft 13 to prevent the axial shaft from being decoupled from the bearing.

The present embodiment, as a preferred embodiment, adopts the above-mentioned first structure, which has a simpler structure, more convenient installation process, and lower cost.

A lower end of the food rack 2 is also provided with a weight 3 for increasing weight, achieving the purpose of the food rack 2 not rotating with the beverage rack 1 more effectively. A bottom of the food rack 2 is defined with a mounting groove 23, the weight 3 is embedded and installed in the mounting groove 23. An opening of the mounting groove 23 is sealed by a sealing plate 24 and a second screw 25. The sealing plate 24 contacts the weight 3 to fasten the weight 3 in the mounting groove 23. The assembly structure is simple and extremely stable.

The food rack 2 is a double-layer structure, which includes an upper frame 201 and a lower frame 202 fixedly connected to each other. The upper frame 201 is provided with at least one second tank 21. The lower frame 202 is provided with at least one second tank 21, which can place more foods, is more convenient to use, and can meet the different requirements of consumers.

One side of a lower end of the upper frame 201 has a first groove 203, and another side of the lower end is defined with a second groove 204. The lower frame 202 is formed with a column 205 configured for inserting into the groove 21. An upper portion of the column 205 is provided with a first protrusion 206. The first protrusion 206 is inlaid in the first groove 203. The assembly structure is simple and firm, and the first protrusion 206 and the first groove 203 can be glued together to further ensure the stability of the assembly structure. A second protrusion 207 is formed on an upper portion of the other side of the lower frame 202. The second protrusion 207 is inlaid in the second groove 204. The assembly structure is simple and firm, and the second protrusion 207 and the second groove 204 can also be glued together to further ensure its stability.

The first tank 12 can also be provided with a plurality of springs for contacting and positioning an outer wall of the container, enabling a more stable support of container. In the case of the container is loose and easy to escape from the first tank 12, this design can accommodate containers of different sizes, and the scope of use is wider, more flexible and more convenient.

As shown in FIG. 1, the beverage rack 1 includes a fixing plate, a side of the fixing plate is provided with at least one limiting member configured for engaging with the first tank 21.

The above-mentioned container can include glass bottles, cans, plastic bottles, etc.

The above-mentioned liquid can be water, beer, beverages, vegetable juice, fruit juice, etc.

In summary, when the device of the present disclosure is used, a container filled with liquid is placed in the first tank 12 of the beverage rack 1 or liquid is directly filled in the first tank 12, and one or more of a variety of foods such as fried chicken, chicken nuggets, peanuts, potato chips, and French fries are placed in the second tank 21 of the food rack 2. When a user holds the handle 11 of the beverage rack 1 and tilts it to pour out the liquid in the container or the liquid in the first tank 12 to drink, since the food rack 2 is rotatably mounted on one side of the beverage rack 1, after the beverage rack 1 rotates, the food rack 2 remains stationary under its own gravity. This ensures that the food will not accidentally fall off from the second tank 21 of the food rack 2 and allows a user's other hand to be freed. The user can not only take any food in the second tank 21 of the food rack 2 to eat with the other hand, but also does not need to go back and forth to the table fetching different foods. It achieves the purpose of quickly and conveniently taking food away from the table, and allows the freed hand to do other things, which is extremely convenient and meets different requirements of different consumers.

The above description is only some embodiments of the present disclosure and is not intended to limit the scope of the present disclosure. Any equivalent changes or modifications made according to the structure, characteristics and principles described in the protection scope of the present disclosure should be included in the protection scope of the present disclosure.

What is claimed is:

1. A rotatable food and beverage holder, comprising:

a beverage rack provided with a handle configured for a user to hold and a first tank configured for accommodating a container or a liquid; and a food rack rotatably mounted on a side of the beverage rack and provided with a second tank configured for placing food;

wherein the food rack remains stationary in response to the beverage rack being rotated;

wherein an upper outer portion of the beverage rack is provided with an axial shaft, an upper outer portion of the food rack is defined with a hole, the axial shaft couples with the hole to form a rotatable connection, and an end of the axial shaft is provided with a first screw or pin for preventing the axial shaft from being decoupled from the hole.

2. The rotatable food and beverage holder according to claim 1, wherein a lower end of the food rack is further provided with a weight.

3. The rotatable food and beverage holder according to claim 2, wherein a bottom of the food rack is defined with a mounting groove, the weight is embedded and installed in the mounting groove, and an opening of the mounting groove is sealed by a sealing plate and a second screw.

4. The rotatable food and beverage holder according to claim 2, wherein the food rack is a double-layer structure comprising an upper frame and a lower frame fixedly connected to each other, the upper frame is provided with at least one of the second tank, and the lower frame is provided with at least one of the second tank.

5. The rotatable food and beverage holder according to claim 4, wherein a side of an lower end of the upper frame is defined with a first groove, another side of the lower end of the upper frame is defined with a second groove, a column is disposed in an interior of the lower frame, an upper portion of the column is formed with a first protrusion, the first protrusion is inlaid in the first groove, a side of an upper portion of the lower frame is formed with a second protrusion, and the second protrusion is inlaid in the second groove.

6. The rotatable food and beverage holder according to claim 1, wherein the beverage rack comprises a fixing plate, a side of the fixing plate is provided with at least one limiting member configured for engaging with the first tank.

7. A rotatable food and beverage holder, comprising:

a beverage rack provided with a handle configured for a user to hold and a first tank configured for accommodating a container or a liquid; and a food rack rotatably mounted on a side of the beverage rack and provided with a second tank configured for placing food;

wherein the food rack remains stationary in response to the beverage rack being rotated;

an upper outer portion of the beverage rack is provided with an axial shaft, an upper outer portion of the food rack is provided with a bearing, the axial shaft is inserted into an inner circular space of the bearing to form a rotatable connection, and an end of the axial shaft is provided with a first screw or pin for preventing the axial shaft from being decoupled from the bearing.

8. The rotatable food and beverage holder according to claim 7, wherein a lower end of the food rack is further provided with a weight.

9. The rotatable food and beverage holder according to claim 8, wherein a bottom of the food rack is defined with a mounting groove, the weight is embedded and installed in the mounting groove, and an opening of the mounting groove is sealed by a sealing plate and a second screw.

10. The rotatable food and beverage holder according to claim 8, wherein the food rack is a double-layer structure comprising an upper frame and a lower frame fixedly connected to each other, the upper frame is provided with at least one of the second tank, and the lower frame is provided with at least one of the second tank.

11. The rotatable food and beverage holder according to claim 10, wherein a side of an lower end of the upper frame is defined with a first groove, another side of the lower end of the upper frame is defined with a second groove, a column is disposed in an interior of the lower frame, an upper portion of the column is formed with a first protrusion, the first protrusion is inlaid in the first groove, a side of an upper portion of the lower frame is formed with a second protrusion, and the second protrusion is inlaid in the second groove.

12. A rotatable food and beverage holder, comprising:

a beverage rack provided with a handle configured for a user to hold and a first tank configured for accommodating a container or a liquid; and a food rack rotatably mounted on a side of the beverage rack and provided with a second tank configured for placing food;

wherein the food rack remains stationary in response to the beverage rack being rotated, a lower end of the food rack is further provided with a weight, a bottom of the food rack is defined with a mounting groove, the weight is embedded and installed in the mounting groove, and an opening of the mounting groove is sealed by a sealing plate and a second screw.

* * * * *